US005832569A

United States Patent [19]

Berg

[11] Patent Number: 5,832,569

[45] Date of Patent: Nov. 10, 1998

[54] LOCKABLE BUCKLE FOR BELTS, STRAPS OR THE LIKE

[76] Inventor: Odd Berg, Myntvägen 9, S-89, Själevad, Sweden

[21] Appl. No.: 977,713

[22] Filed: Nov. 25, 1997

[51] Int. Cl.[6] ..... A44B 11/00

[52] U.S. Cl. ..... 24/170; 24/179; 24/191

[58] Field of Search ..... 24/170, 171, 174, 24/179, 191, 194

[56] References Cited

U.S. PATENT DOCUMENTS

| | | | |
|---|---|---|---|
| 44,693 | 10/1864 | Tattershall . | |
| 252,092 | 1/1882 | Fluck . | |
| 0,330,213 | 11/1885 | Deweese | 24/170 |
| 565,396 | 8/1896 | Stansbury . | |
| 708,359 | 9/1902 | Johnson et al. . | |
| 904,707 | 11/1908 | Meinhardt . | |
| 2,287,722 | 6/1942 | Beazley . | |
| 2,334,462 | 11/1943 | White . | |
| 2,442,266 | 5/1948 | Davis . | |
| 2,517,424 | 8/1950 | Griswold . | |
| 3,020,612 | 2/1962 | Meeker | 24/170 |
| 3,152,374 | 10/1964 | Round . | |
| 3,276,085 | 10/1966 | Spranger . | |
| 3,678,542 | 7/1972 | Prete, Jr. | 24/170 |
| 4,233,713 | 11/1980 | Berg . | |

FOREIGN PATENT DOCUMENTS

| | | |
|---|---|---|
| 934 522 | 5/1948 | France . |
| 446 791 | 3/1968 | Switzerland . |
| 15 973 | 7/1914 | United Kingdom . |

*Primary Examiner*—Victor N. Sakran
*Attorney, Agent, or Firm*—Flynn, Thiel, Boutell & Tanis, P.C.

[57] ABSTRACT

A lockable buckle for belts, straps and the like, consisting of an exterior housing, or shoe, accommodating a freely movable locking slide which forms, between it and the inside of the shoe, a locking area for nipping a belt or the like passing through the buckle. Locking is brought about by means of a manually operated eccenter mechanism engaging the rear end of the slide. The belt is arranged to enter the front of the buckle from below through an opening in the shoe and to pass over a rigid, profiled rib at the front end of the slide before entering the locking area under the slide. When the buckle is locked and the belt is under load, the tension in the belt will press this end of the slide against the belt, assisting the locking action exercised by the eccenter mechanism. One end of the belt can be secured to the rear end of the shoe by friction, by being threaded back and forth through openings in the shoe, and in such a way that it becomes strictly aligned with the other end of the belt, entering the front end of the buckle.

3 Claims, 2 Drawing Sheets

LOCKABLE BUCKLE FOR BELTS, STRAPS OR THE LIKE

The present invention relates to lockable buckles for belts, straps, bands and the like, here referred to as belts, more precisely such buckles which excercise their locking action by friction and are taken from a locked position to an open or free position, and vice versa, by means of a manual operating means.

Such a belt buckle is used in such a way, for example, that it is attached to one end of a belt, while the other end of the belt is threaded through an opening in the buckle to form a running part which can be nipped in the buckle in an optional position, e.g. by an eccentric mechanism, a wedge, a rocker plate or the like. In such cases the buckle it most often self-locking, i.e. the locking force increases when the belt is subjected to load, by the part of the belt running through the buckle being subjected to a wedging action.

Such buckles have the disadvantage to function less acceptably when used together with belts of modern synthetic material, such as amide plastics or polyester plastics (trade names nylon, terylene etc.), because these materials have rather low surface friction, and are sensitive to local compressive stresses, when the material easily becomes plastically deformed. In the known buckles, the belt will namely be subjected to a locally restricted nipping action causing the material to deform and yield which, in combination with a low surface friction, results in that the belt starts to creep in the buckle.

A buckle proposed by me, according to e.g. my U.S. Pat. No. 4,233,713 and to which reference is made, has proved to function excellently with such belts of plastics material, and this buckle has competed successfully with buckles of similar type, in particular when high loads are to be carried. However, experience did show that certain improvements would be desirable, but it also turned out that attempts to modify the buckle in order to meet these desires created constructive problems, not so easy to solve. According to the present invention, however, practical solutions have been presented and in the following a buckle such modified will be described in greater detail, after which a comparative analysis of the buckle of the said patent and that now proposed will be made.

The buckle will be described with reference to the accompanying drawings, in which FIG. 1 shows a longitudinal section along line I—I in FIG. 2 through an outer housing or shoe component of the buckle according to the invention;

Figure 6:
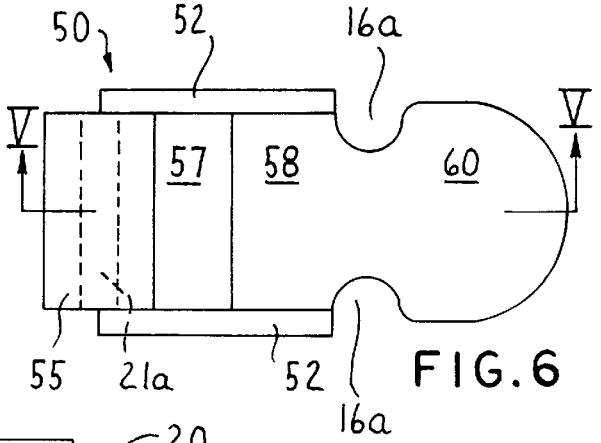
FIG. 6 shows a plan view of the locking arm.
Figure 7:
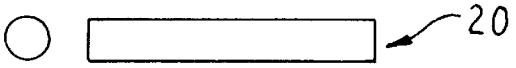
FIG. 7 shows a bearing pin upon which the locking arm is carried in the shoe.

The belt buckle according to the invention comprises three main parts, namely, an outer housing or shoe 10 (FIGS. 1 and 2), a slide 30 (FIGS. 3 and 4) moveable in the shoe, and an operating or locking arm 50 (FIGS. 5 and 6) journalled in the shoe 10 by means of a pin 20 (FIG. 7). The coaction of the different parts will be described in detail in the following.

Figure 1:
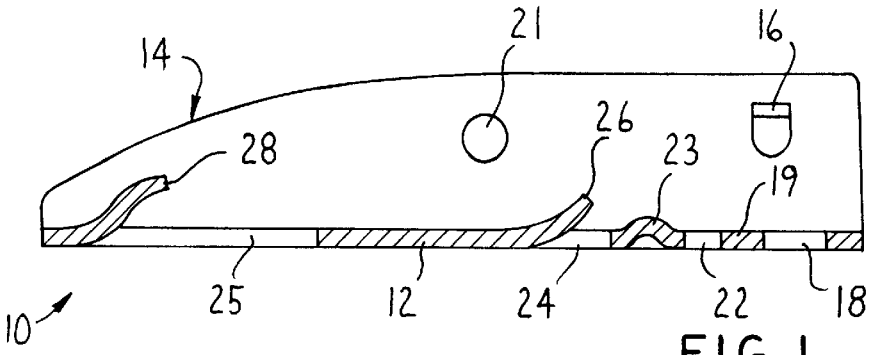
Figure 2:
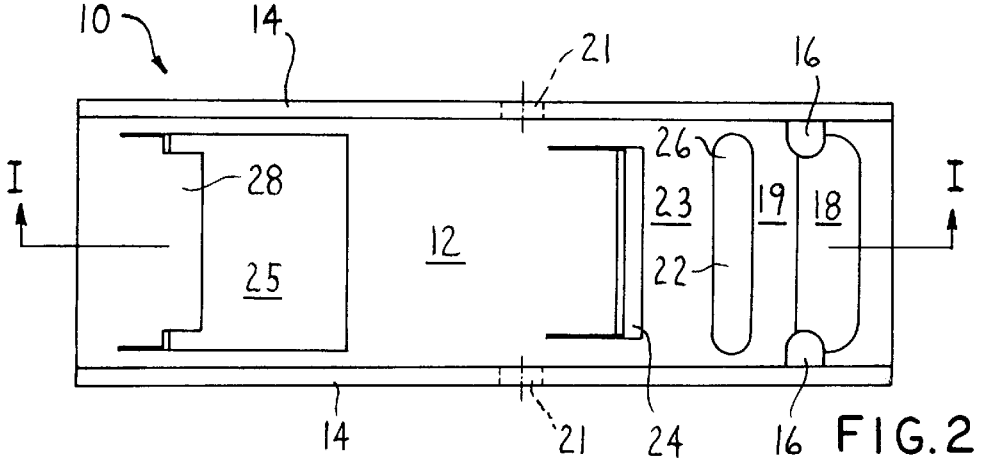
FIG. 2 shows a plan view of the said shoe.

The shoe 10, see FIG. 1 and 2, has the general configuration of an outwardly open U-shaped plate with a web or bottom 12 and two upstanding flanges or cheeks 14. At one end of the shoe, the rear end to the left in the figures, referred to as the anchoring end or securing end, two ears 16, opposite each other, are inwardly bent out from the material of the respective cheeks 14. In the bottom 12 of the housing two transverse openings or slots 18 and 22 are made, leaving between them a rib 19. A third transverse slot 24 is made somewhat further into the shoe, the slot in this case being made by forcing up a lip 26 from the bottom 12, the lip being given a rounded cross section, as apparent from FIG. 1. Between slots 22 and 24 a second rib 23 is formed which for stiffening is curved upwards somewhat, as shown in FIG. 1.

At the opposite or front end of shoe 10 a further slot or rather opening 25 is made, this opening being defined at its left end, near the end of the shoe, by a rounded lip 28 forced up from the bottom 12, see FIG. 1. Bearing apertures 21 for pin 20 are arranged opposite each other in cheeks 14 of the shoe (FIG. 7).

Figure 3:
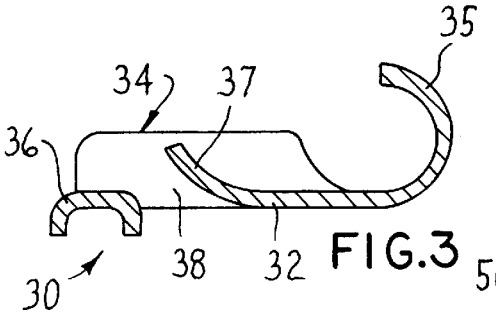
FIG. 3 shows a longitudinal section along line III—III in FIG. 4 through a slide component of the buckle.
Figure 4:
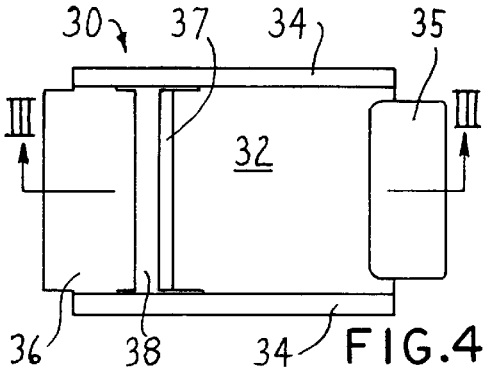
FIG. 4 shows a plan view of the slide.

The moveable slide 30, see FIGS. 3 and 4, is intended to fit slideably between cheeks 14 of shoe 10 and has also a substantially U-shaped cross section. It consists of a bottom portion 32 with upstanding flanges or cheeks 34, which thus have a running fit between cheeks 14 of shoe 10. The rear or righthand end of the bottom portion 32 is extended and bent upwards into a circular tongue 35. Furthermore, opposite tongue 35 the front or left-hand end of bottom 32 is also bent up, here into a lip 37. Cheeks 34 are extended past lip 37 and united by a bridge 36. It is vital for the proper function of the buckle that this bridge 36 be very strong, and therefore it is shaped, in this case, as an inverted U-bar. Such a profile makes it possible to press the bridge from the material, comparatively thin, of slide 30 and still maintain the stability of the slide when the buckle is under heavy load. As apparent from FIGS. 3 and 4 lip 37 and bridge 36 leave between themselves an opening 38 through which the belt is lead, as will be described.

Figure 5:
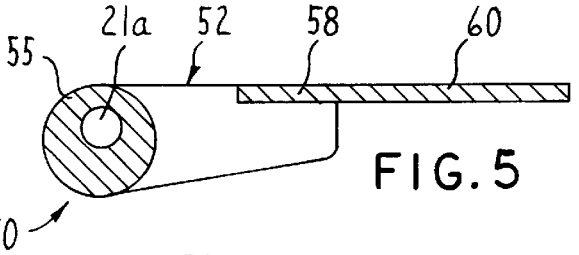
FIG. 5 shows a longitudinal section along line V—V in FIG. 6 through the operating means or locking arm of the buckle.

Finally, with respect to the locking arm 50 shown in FIGS. 5 and 6, this is made preferably of hard plastics material and consists of a substantially cylindrical, eccentrically journalled cam portion 55, to the ends of which are attached opposing side pieces 52. The free ends of the latter are united by a bridge 58 extending along the upper edges of side pieces 52, leaving an opening 57 between itself and cam portion 55, as is apparent from FIGS. 5 and 6. The bridge continues outwardly in the form of a thumb-piece or handle 60, which is partly separated from bridge 58 by recesses 16*a* taken up on either side, opposite one another, see FIG. 6. The cam portion 52 is provided with a through-going bearing bore 21*a*, eccentrically situated and adapted to accommodate the above-mentioned pin 20. The outside width of locking arm 50 as a whole is adjusted s as to fit between cheeks 14 of shoe 10 with inconsiderable play.

Figure 8:
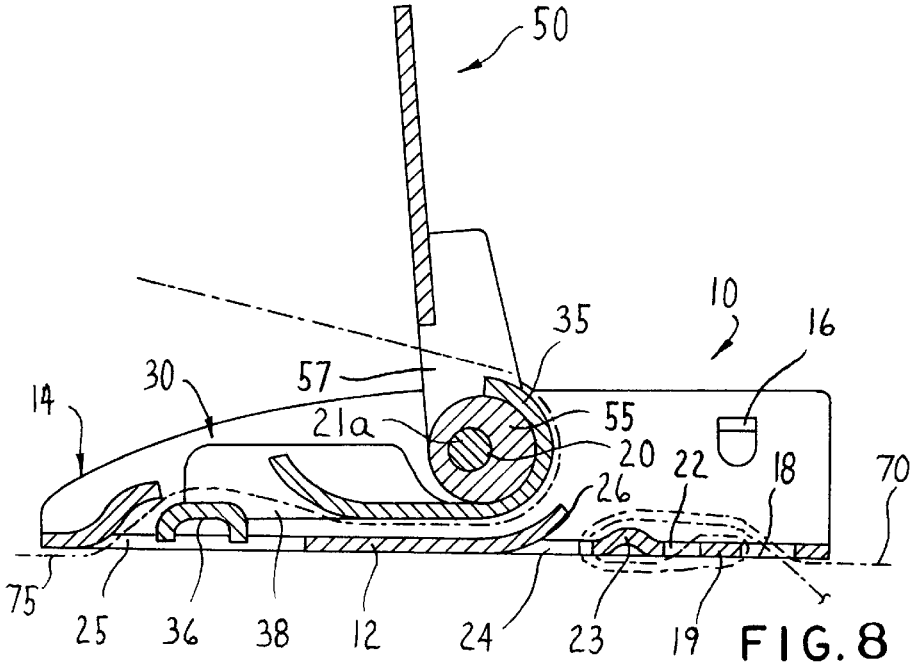
FIGS. 8 and 9 show longitudinal sections through the assembled buckle together with a coacting belt, in open and locked position, respectively.
Figure 9:
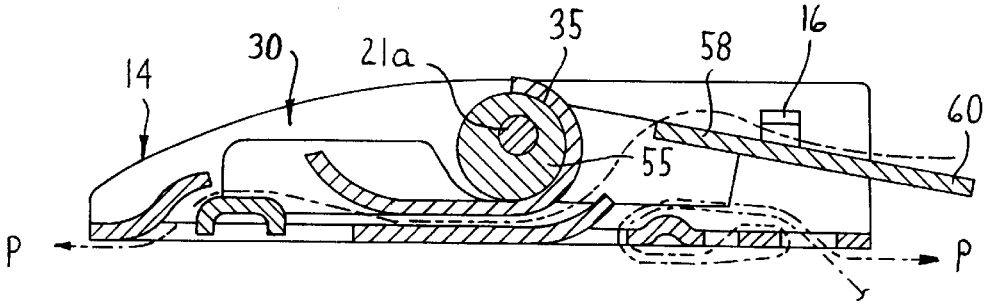

The longitudinal sections of FIGS. 8 and 9 show the buckle in assembled position and illustrates the cooperation of the various components with a typical plastics belt. The slide 30 is thus inserted between cheeks 14 of shoe 10 such that its tongue 35 is facing the said rear anchoring or securing end of the shoe, that is, the right end of the shoe as viewed in the figures. Locking arm 50 is in turn placed between the shoe cheeks 14 with its bearing bore 21*a* aligned with the bearing openings 21 in the cheeks, whereupon pin 20 is inserted in said bore and openings. The cam portion 55 of locking arm 50 is now accomodated inside the circular tongue 35 of slide 30, as shown in FIGS. 8 and 9.

FIG. 8 thus shows the buckle in its open position when a belt can be pulled freely therethrough, as will be described in greater detail below. In this position locking arm 50 has been moved to stand substantially straight upwards, the eccentrically journalled cam portion 55 then assuming such a position, see FIG. 8, that slide 30 is raised somewhat in shoe 10 by its cooperation with the cam portion, allowing the belt to pass freely. When arm 50 is then swung downwards to the position according to FIG. 9, slide 30 will be pushed into its locking position, engaging and clamping the belt underneath. It is noted that in lowering arm 50 into locking position ears 16 of cheeks 14 are passed by the handle portion 60 which lets through the ears through its recesses 16*a* (FIG. 6).

How the buckle of the invention coacts with a belt will now be described with reference to FIGS. 8 and 9. As in my buckle previously proposed one end 70 of the belt is anchored and secured at the rear end of the buckle, thus according to the figures the right end, while the rest of the belt is placed e.g. around an object to be slung. Then the other end 75 of the belt is threaded from the front through the buckle and forms a free running part which is tightened about the object to then be fixed immovably in the buckle in its tightened position by the locking arm being swung down, as described above. As a matter of course the buckle will operate in the same manner if it is to connect two separate belts in a selected position, releaseble in relation to one another.

An important feature of the belt buckle described is that there is no dependence on, for example, riveting, sewing or similar measures for anchoring the belt end 70. Instead, it can be threaded back and forth in the openings or slots provided in the buckle for the purpose, giving the belt an immovably fixed anchorage by frictional engagement with cooperating portions of the buckle. In FIGS. 8 and 9 the itinerary of the belt is indicated by chain-dotted lines, and the stationay belt end 70 is threaded in the following way, see the right part of FIG. 8. First the belt end is threaded from the rear and below up through slot 18, then forwards and through slot 24 which is passed downwards, further forwards and upwards through slot 18, back downwards through slot 22, round rib 23 and up through slot 24, then backwards below the just threaded part, and finally downwards through slot 18 to finish up just outside the shoe in eL short end piece 70'. If a force P is applied in the belt its loops will engage ribs 19 and 23 of the buckle in accordance with the pattern shown and be immovably anchored on the rear part of the buckle.

The other, free end 75 of the belt is threaded in from below through opening 25 at the front end or entrance end of the buckle, to the left in the figures, over the U-rib 36 of slide 30, further down through opening 38, in under bottom 32 of the slide and above bottom 12 of shoe 10, up around the outside of the curved tongue 35 of the slide and out through opening 57 of locking arm 50. By thus pulling the free belt end 75 through the now open buckle the belt can be tensioned about the object to be slung, after which the system can be fixed and secured by locking arm 50 being moved down clockwise, the eccenter portion (55) thereof then compressing bottom 32 of slide 30 against the belt, and thanks to the creative frictional and wedging effect of the buckle the belt will withstand any tendency to slide in the buckle; a possible overload will result in rupture, not slipping. In particular it should be noted that the slide is engaging the belt in a "balanced" way: its one end is pressed downwards by eccenter 55, its other end by the tension in the belt exercising a downwardly directed force p (see FIG. 8) on bridge 36, thus enhancing the locking action.

Particularly advantageous is the fact that the locking arm 50 of the buckle can be retained in its locking position and prevented from unintentional movement towards the open position. This is done by the free belt part 75 being placed against the top side of the flat portions 58, 60 of the locking arm, while at the same time the edges of the belt are inserted between and under ears 16 of shoe 10.

When designed as illustrated the belt buckle according to the invention will be substantially "equal in strength" to the cooperating plastics belt which, thanks to its modern material composition, is capable of carrying very large loads. This equality in strength means that when the belt approaches its breaking load, the buckle will approach correspondingly its load limit. The consequence is thus that the excellent loading capacity of a modern plastics belt can be utilized to its full extent. Unfortunately, however, this desirable property of equality is not exhibited by my earlier belt buckle referred to in the introduction; it functions impeccably as to its locking effect but starts to deform while the belt is still rather far from its breaking point which, in a commonly used type of belt, lies around one ton.

Figure 10:
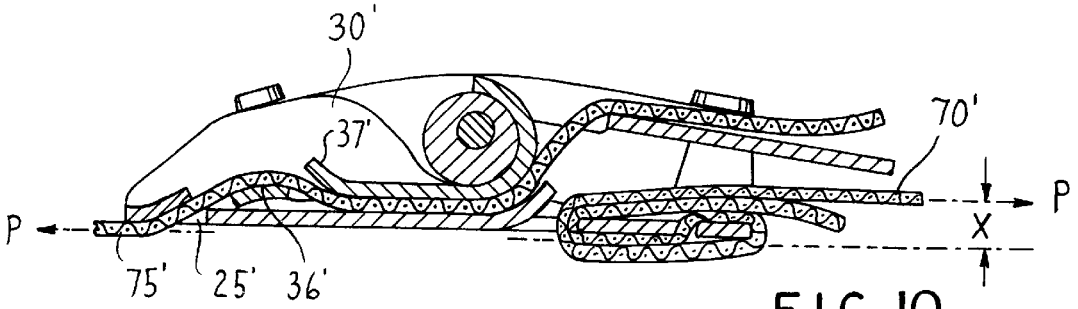
FIG. 10 shows a longitudinal section corresponding to FIG. 9 but through a buckle of the earlier design mentioned above, together with a cooperating belt and in locking position.

It has turned out that this weakness resides in the slide 30' of the buckle, see FIG. 10, whose transverse rib 36' yields and is bent at large belt loads, and in doing so deforms the slide considerably. Hereby the buckle looses its maneuverability, and it can be impossible to release the belt. Unfortunately, the slide has also shown to stress heavily the pressing tool used for its making, more particularly when the narrow rib 36' is formed while the tongue 37' is pressed up. The operation has shown to bring with it serious damage to the tool after a too limited number of slides manufactured. According to the invention these problems have been solved by the transverse rib 36 being formed with a U-shaped profile as described in the foregoing, at the same time as a large free space is left in the bottom of the shoe 10 of the buckle by the previously narrow gap 25' being expanded greatly so as to form a wide opening 25, see FIGS. 1, 2 and 8, 9.

Another feature of the earlier buckle which, somewhat surprising, turned out to be an inconvenience in certain cases, is the fact that loading the buckle caused it to tilt. The explanation is that the running and fixed parts, respectively, of the belt, that is, on the one hand the part 75' which runs into the buckle, i.e. to the left in the figures, and is fixed therein in the selected position and, on the other hand, the part 70' outgoing from its anchoring point to the right in the figures do not extend mutually aligned, i.e. parallel to one another. Instead, under load their center lines will be displaced a distance x, see FIG. 10, hence the tilting moment excercised on the buckle. This situation is unavoidable however the belt is threaded in the older buckle. As indicated, in certain cases of application the tilting has turned out to be a disturbing inconvenience. However, according to the invention the defect is remedied by the buckle being lengthened somewhat and a third, outer "threading slot" 18 introduced, see the earlier figures, whereby the belt can he threaded in such a way that the outrunning parts become aligned and thus all tilting moments on the buckle proper be eliminated, see FIGS. 8 and 9. In addition, the anchoring of the belt in the buckle is further secured.

By the solutions proposed herein of the problems discussed, associated with my earlier buckle, a new belt buckle has been created whose usefulness and reliablilty has been considerably increased, which tests and experiments have shown. Hopefully therefore my modified buckle will be received favorably when launched on the market.

I claim:

1. A lockable buckle for belts, straps, and the like comprising an exterior shoe and a locking means accomodated therein and movable between a locked position and an open position for permitting a belt or the like to pass freely through the shoe in the opened position of the locking means and alternatively for becoming locked and fixed in the shoe under friction at an optional place along the belt when the locking means is moved into the locked position, the buckle comprising:

A) a shoe (10) of general U-configuration with a front end and a rear end and having a bottom portion (12) and upstanding cheeks (14), B) a slide (30) movable in said shoe, likewise of general U-configuration and with a front and rear end, corresponding to those of the shoe, and having a bottom portion (32) and upstanding cheeks (34), and C) a cam means (50) pivotally mounted in said shoe (10) and actuated by an operating arm (60) for engagement with said slide, said shoe and said slide forming between their respective bottom portions a locking area, through which the belt passes for nipping in the locked position between the slide and the shoe, said cam means being engageable with the slide adjacent the rear end thereof for pressing the slide against the belt on assuming the locked position, and for lifting the slide from the belt when assuming the open position by the slide including at its said rear end a portion partially surrounding the cam means for said lifting, the buckle being further characterized in that first, the cheeks (34) of the slide are extended from the front end of the slide with a bridge (36), profiled for rigidity, uniting said front cheek extensions (34) and defining with said bottom portion (32) of the slide a passage opening (38) for the belt, secondly, the shoe (10) is provided at its rear end with three transverse, parallel openings (18, 22, 24) for threading an end piece (70) of the belt back and forth in said openings to rigidly anchor the belt end by friction in the buckle, and thirdly, an opening (25) of considerable width is provided in the bottom (12) of the shoe (10) at the opposite, front end of the shoe for accommodating said rigid bridge (36) of the slide (30) and also the running part (75) of the belt which is arranged to enter from below and to pass over said bridge for arriving into the locking area.

2. A buckle as claimed in claim 1, in which the rigid, profiled bridge (36) of the slide (30) has the form of an inverted U-bar.

3. A buckle as claimed in claim 2, in which the end piece (70) of the belt is threaded through the three rear shoe openings (18, 22, 24) into such a position that it extends from the buckle in straight alignment with the belt part (75) entering the front of the buckle.

* * * * *